United States Patent [19]

Reinelt et al.

[11] Patent Number: 4,702,167

[45] Date of Patent: Oct. 27, 1987

[54] PROPELLANT-CHARGE MODULE

[75] Inventors: Kalrheinz Reinelt, Hermannsburg; Michael Schwenzer, Duesseldorf, both of Fed. Rep. of Germany

[73] Assignee: Rheinmetall GmbH, Duesseldorf, Fed. Rep. of Germany

[21] Appl. No.: 858,209

[22] PCT Filed: Aug. 24, 1985

[86] PCT No.: PCT/EP85/00433

§ 371 Date: Jun. 6, 1986

§ 102(e) Date: Jun. 6, 1986

[87] PCT Pub. No.: WO86/01584

PCT Pub. Date: Mar. 13, 1986

[30] Foreign Application Priority Data

Sep. 1, 1984 [DE] Fed. Rep. of Germany ..... 3432291

[51] Int. Cl.[4] ..... F42B 5/38

[52] U.S. Cl. ..... 102/282; 102/283; 102/285

[58] Field of Search ..... 102/282, 283, 285, 286, 102/530, 314, 331

[56] References Cited

U.S. PATENT DOCUMENTS

| | | | |
|---|---|---|---|
| 2,405,104 | 7/1946 | Mydens | 102/282 |
| 3,176,617 | 4/1965 | Brafford | 102/282 |
| 3,201,936 | 8/1965 | Bancelin | 102/285 X |
| 3,204,560 | 9/1965 | Gustavson | 102/285 |
| 3,264,997 | 8/1966 | Michael | 102/283 |
| 3,304,867 | 2/1967 | Nadel | 102/282 X |
| 3,340,809 | 9/1967 | Stadler et al. | 102/283 X |
| 3,372,643 | 3/1968 | Kvavle | 102/283 X |
| 4,463,679 | 8/1984 | Billard | 102/336 |

FOREIGN PATENT DOCUMENTS

| | | | |
|---|---|---|---|
| 691639 | 7/1964 | Canada | 102/285 |
| 1514293 | 1/1968 | France . | |

*Primary Examiner*—David H. Brown

[57] ABSTRACT

A propellant-charge pack has an annular envelope having an outer wall extending along and centered on an axis, a pair of axially spaced end walls extending transversely inward from the axis and having inner peripheries centered on the axis, and an inner wall defining a clear axially throughgoing passage between the inner peripheries of the end walls. The envelope is generally axially symmetrical about the axis, that is it is formed as a body of revolution or of regular polygonal section, and is substantially symmetrical to a plane perpendicular to the axis midway between the end walls. A relatively easily ignited primer charge forms a part of the inner wall symmetrical of the plane and a propellant charge fills the envelope between the walls outward of the inner wall. The primer charge is of such high combustibility, compared to the diameter of the passage, that the entire primer charge, even of a stack of such packs, will be ignited before they burn through and set off the respective propellant charges.

10 Claims, 5 Drawing Figures

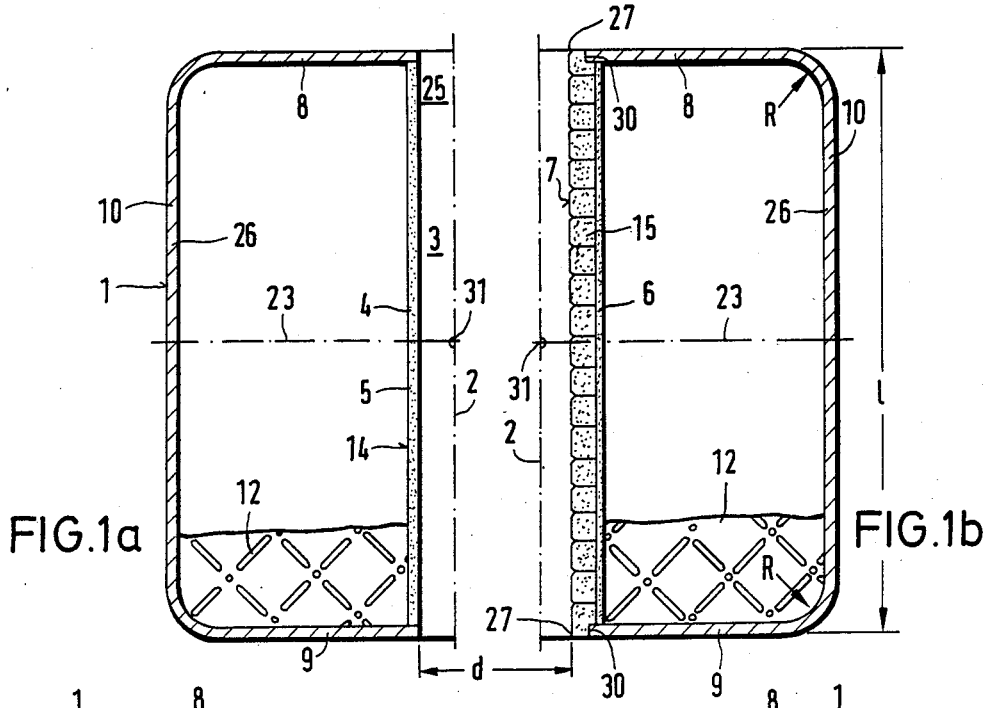
FIG.1a
FIG.1b
d
l
R
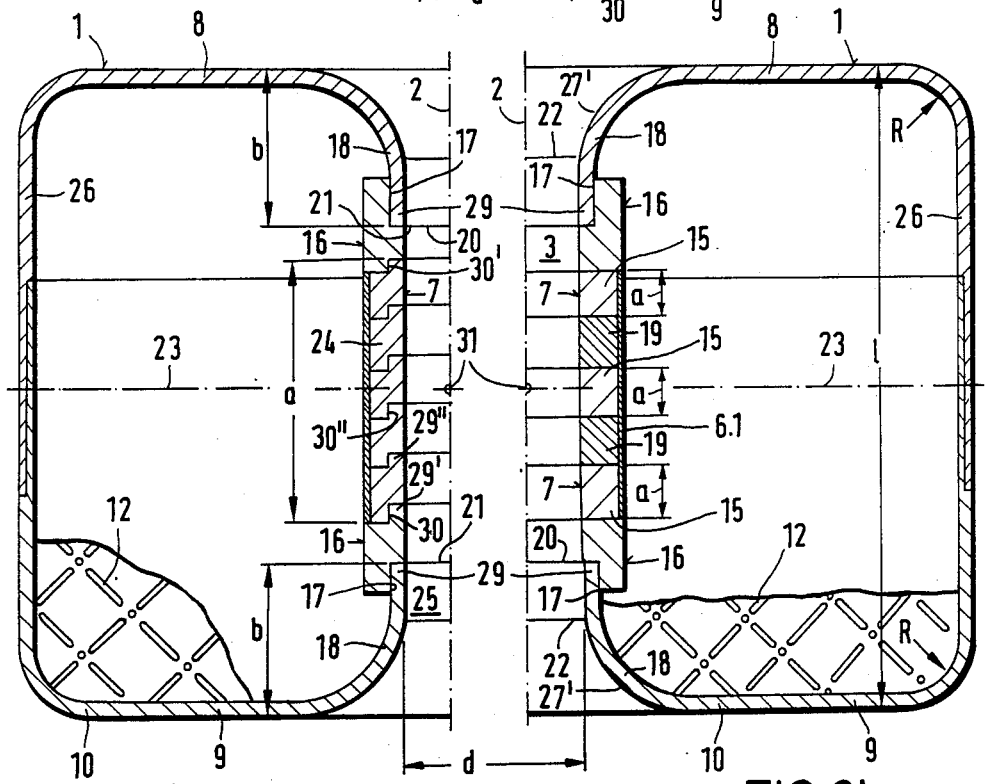
FIG.2a
FIG.2b
a
b
d
l
R

PROPELLANT-CHARGE MODULE

FIELD OF THE INVENTION

The present invention relates to a propellant-charge module. More particularly this invention concerns such a module used to fire a separate projectile.

BACKGROUND OF THE INVENTION

In the use of separate ammunition at least one propellant-charge module is dropped into the barrel, followed by the projectile to be fired. A primer cap is then detonated to ignite a primer charge in the charge pack, which in its turn ignites the propellant charge. In the simplest system, the pack simply comprises a bag of the propellant charge provided at one end with the primer or detonating charge.

German published patent specification No. 3,113,406 discloses the use of a rigid cardboard cartridge sleeve instead of a powder bag. These cartridge sleeves contain an end charge and a centrally arranged transmitting charge as well as an augmenting charge and, in order to improve and speed up the ignition, a relatively space-consuming cavity for catching the detonating blast.

A substantial disadvantage of this arrangement is that it is impossible to stack up a number of the cartridge sleeves, since when the stack is too long gas pressures vary excessively within the firing chamber. Furthermore propellant-charge powder subject to brittle failure is destroyed at the base of the shell, which can lead in bad cases to ruining of the shot or even of the weapon. In addition it is possible to put these cartridge sleeves or powder bags into the chamber upside down, leading to misfiring and in extreme cases to damage to the weapon.

Studies of barrel-type weapons using such or similar modular loose-powder propellant charges have showed that especially at charge densities of more than $0.4 g/cm^3$ irregular gas-pressure curves and therefore nonreproducible trajectories are produced. The cause of this performance lies in the unsatisfactory central burnthrough of the charge pack, which effect is even greater with end-lit charges.

OBJECTS OF THE INVENTION

It is therefore an object of the present invention to provide an improved propellant-charge pack or module.

Another object is the provision of such a propellant-charge pack which overcomes the above-given disadvantages, that is which can be stacked up in substantial numbers without problems, and that can be loaded easily.

A further object is to provide an improved method of loading and firing separate ammunition including the pack according to this invention.

SUMMARY OF THE INVENTION

A propellant-charge pack according to the invention has an annular envelope having an outer wall extending along and centered on an axis, a pair of axially spaced end walls extending transversely inward from the axis and having inner peripheries centered on the axis, and an inner wall defining a clear axially throughgoing passage between the inner peripheries of the end walls. The envelope is generally axially symmetrical about the axis, that is it is formed as a body of revolution or of regular polygonal section, and is substantially symmetrical to a plane perpendicular to the axis midway between the end walls. A relatively easily ignited primer charge forms a part of the inner wall symmetrical of the plane and a propellant charge fills the envelope between the walls outward of the inner wall. The primer charge is of such high combustibility, compared to the diameter of the passage, that the entire primer charge, even of a stack of such packs, will be ignited before they burn through and set off the respective propellant charges.

The provision of a clear ignition passage inside the primer charge of the propellant-charge module advantageously provides a nearly instantaneous ignition of the propellant-charge powder over the entire length of the charge and thereby a minimal pressure differential inside the chamber. As a result it is possible to set the gas-pressure curve so that a perfectly reproducible trajectory is obtained, even with long charge lengths.

The axially symmetrical arrangement of the primer charge in the ignition-passage wall ensures in addition to a rapid and central ignition of the propellant-charge powder a simple manufacture and emplacement of the primer charge inside the propellant-charge module.

According to another feature of this invention the primer charge is shaped as a tube centered on the axis and constituting the inner wall. A particularly simple assembly is obtained when the primer tube is formed as the wall of an integral primer-charge body. A simple variation of the length of the primer charge is made possible by the use of endwise stacked rings and these rings can be arranged to be self centering. The centering formations of each ring include an axially projecting rim and an axially oppositely open complementary recess. In addition spacers are provided between each of the inner ends extending axially inward from the inner end-wall peripheries and the stack of primer-charge rings.

The propellant-charge module particularly advantageously permits any axial length to be used in the charge chamber. To this end the envelope is symmetrical axially and radially of the central axis so that the propellant-charge modules can be stacked up facing in either direction relative to the end wall and the ignition can be started from either end by setting off the respective module with an ignition blast.

The inside diameter of the ignition passage is advantageously sized such that the propagation of the ignition blast is faster along the entire length of the primer charge than it is radially from the primer charges to the propellant charge. This can be achieved by using a nitrocellulose-type primer.

Depending on the type of artillery shot desired any number of identical such modules can be loaded. Hence this advantageously avoids the interruptions in shooting caused by use of different-length charges.

The propellant charges are further capable of being stored indefinitely without protection from moisture. They can be handled in an uncomplicated manner and can even be manipulated easily in the dark, because now they can be put either end first into the chamber.

As a result of their uniformity and interchangeability the propellant-charge modules can now be loaded automatically. A time-consuming presorting is advantageously eliminated so that the propellant-charge modules can be stored in a simple manner and not in any particular orientation in the supply magazine. Hence the firing rate can be increased relative to the known propellant-charge modules for an increased usefulness for the weapon.

The instant invention also relates to a method of using such a pack. This method comprises the steps of first stacking a plurality of the packs axially one atop the other in the barrel above a primer cap with the pack axes coaxial, then loading a projectile into the barrel atop the stack of packs, and finally firing the primer cap and thereby detonating the primer charges of the inner walls before detonating the propellant charge. As mentioned, since the packs are axiosymmetric about the central axis and planosymmetric about the central crosswise plane, they can be stacked up without regard to axial orientation, so long as the axes are aligned.

According to a further feature of this invention each pack further comprises a waterproof but frangible foil blocking the passage at each end wall. In this case the method further comprises the step of blowing out the foils on firing of the primer cap to axially interconnect all of the passages. This can be done by using as primer cap a blank-type cartridge whose wadding will destroy the moisture-protecting foils ahead of the flame blast that serves to detonate the primer charges.

DESCRIPTION OF THE DRAWING

The above and other features and advantages will become more readily apparent from the following, it being understood that any feature described with reference to one embodiment of the invention can be used where possible with any other embodiment. In the accompanying drawing:

FIGS. 1*a* and 1*b* are axial sections taken respectively through the left and right halves of packs according to this invention;

FIGS. 2*a* and 2*b* are similar axial sections through the left and right halves of two more packs in accordance with this invention.

SPECIFIC DESCRIPTION

Figure 3:
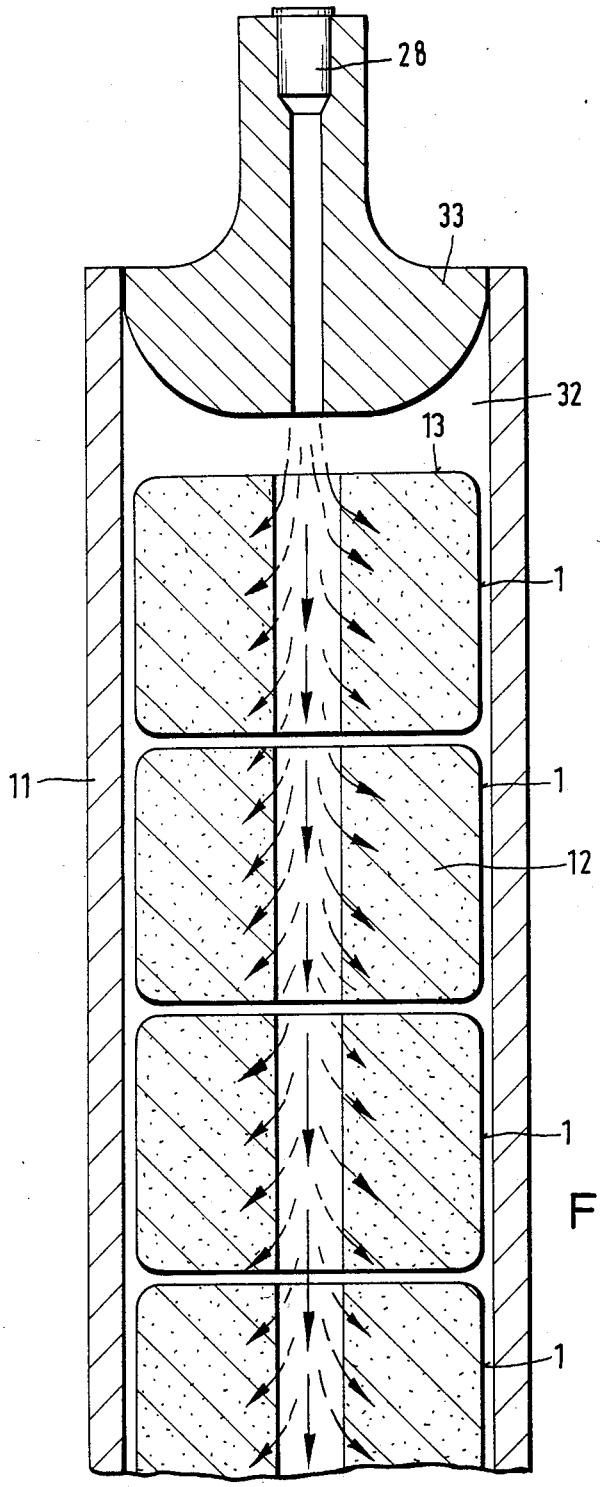
FIG. 3 is a largely diagrammatic axial section showing how the packs are combined in a barrel-type weapon according to the invention.

As seen in FIGS. 1*a*, 1*b*, 2*a*, and 2*b* a propellant-charge module 1 according to the invention has an envelope 10 and a body of black-powder-type propellant-charge powder 12. A detonation passage 3 extends the entire length 1 of the module and defines a clear center space 25. The envelope 10 is axiosymmetric about its longitudinal axis 2 and is planosymmetric about a plane 23 extending perpendicularly through the axis 2 at the module's center 31.

The outer wall 26 of the envelope 10 is as is standard tubular and cylindrical or of polygonal section, the two end walls 8 and 9 are planar and perpendicular to the longitudinal axis 2 with the same radii R of curvature at their outer edges and with inner peripheries or edges 27, 27' of the detonation passage being of the same centered shape.

The clear detonation passage 3 is formed mainly by the primer charge 5, 7 which is also symmetrical between the end walls 8 and 9 of the envelope 10.

The shape of the envelope 10 and of the detonation passage 3 make it possible to stack up the propellant-charge modules in a barrel 11 (FIG. 3) in any axial orientation of the end walls 8 and 9 so that in each charge position 13 (FIG. 3) the ignition of the respective propellant-charge module is started by the ignition blast at the respective end wall 8 or 9.

The diameter d of the clear space 25 of the detonation passage 3 is of such size that the ignition blast is propagated more rapidly along the entire length of the charge than the radial ignition from the primer charges 5 and 7 of the propellant-charge powder 12, the charge length being equal to the sum of the individual lengths L of the stack of propellant packs 1 in the barrel 11 (FIG. 3).

The inner diameter d can range, depending on factors such as the propagation speed of the ignition flame or the blast from the primer cap 28 (FIG. 3) and the burn characteristics of the primer charge and the caliber, from 5 mm to a maximum of 40 mm, a particularly advantageous diameter range being between 12 and 30 mm.

FIG. 1 shows differently constructed primer charges 5 and 7 on the left and right sides, both with the same diameter d and length L. On the left side (FIG. 1*a*) the surface 4 defining the passage 3 is formed by a single throughgoing tube 14 whose wall is formed of an integrated primer charge 5, preferably of extruded porous nitrocellulose or extruded porous nitrocellulose admixed with a known primer charge. The tube 14 is secured in a not illustrated manner to the end walls 8 and 9.

On the right side (FIG. 1*b*) the wall of the detonation passage 3 is formed radially outside by a noncombustible support tube 6 and radially inside by a primer charge 7 centered on this tube 6. This primer charge 7 is formed of a stack of tablet rings 15 whose overall length corresponds to the module length L. Instead of the support tube 6 and the tablet rings 15 it is possible also to used an arrangement of self-centering tablet rings 24 (FIG. 2*a*).

The rings 16 at both ends of the detonation passage 3 as well as the rings 24 have centering formations 30, here axially interfitting rims and grooves, for fixing them centrally on the end walls 8 and 9. FIGS. 2*a* and 2*b* also show a charge 7 formed by a stack of end-on tablet rings 15 and 24 which extends symmetrically along a only a central portion portion a of the module length 1.

The envelope 10 has, in order to centrally symmetrically hold the charge 7 in the middle portion, collars 18 extending the same distance b inward from the outer peripheries 27' of end walls 8 and 9 and serving with spacers 16 to support the ends of the tablets 15 and 24.

The collars 18 are formed with identical tube extensions 29 at the inner edges of the end walls 8 and 9, which extensions can be rounded. In order to secure the spacers 16 on the respective extensions 29 they have axially outwardly directed centering formations 17. In contrast to the passage-side position of the centering formations 17 shown in FIGS. 2*a* and 2*b*, they can also engage on the propellant-powder side axially outwardly to receive the respective extension 29.

The spacers 16 serve to axially fix the primer charge 5, 7. They can also, as shown on the left in FIG. 2*a*, be formed with a radially inwardly projecting rim 29' or a centering formation 30' to radially fix the self-centering tablet rings 24.

For this self-centering action the tablet rings are each formed at their axial ends also with an axially projecting extension 29'' and a centering formation 30''. The tablet rings can in this way be stacked on one another, centering themselves axially in one another also.

Although the use of self-centering rings 24 eliminates the need for an additional support tube 6, it is absolutely necessary for radially fixing the rings 15 shown in FIG. 2*b* which have no self-centering action. The support tube 6.1 is connected in a not illustrated manner with the spacers 16.

The rings 15, 24 permit on the one hand a fixing of the primer charge in a connnected-together axially symmetrical region a (FIG. 2*a*), on the other hand, however, they also allow with the use of the spacers 19 an axially symmetrical arrangement of the primer charges 7 in several regions a.

To protect the primer charge 7 and the propellant charge powder 12 of the propellant-charge module 1 against moisture during storage, foils 20 which can be discarded, burnt off, or torn, are used. The foils 20 can be secured in the detonation passage 3 onto the inwardly turned edges 21 of the support tube 18 or on the outwardly directed widenings 22 or on the intake and output of the passage 3 on the transitions from the support tube 18 to the end plates 8 and 9. They can be separate parts and can also be part of the end walls 8 and 9 of the envelope 10.

In order to prevent objects from fouling the primer chamber 32 (FIG. 3) the envelope 10, the spacers 16 and 19 and the support tube 6 are of combustible material like the type normally used in separate ammunition. The material of the envelope 10 is however of such rigidity that it is possible to load a shot comprising a not illustrated projectile and the charge formed by the propellant-charge module 1 in a single operation. The primer charge formed by the annular tablets 15 and 24 is of known material and can for example be made of a boron/potassium-nitrate powder. Standard black powder can preferably also be used as propellant-charge powder 12.

FIG. 3 shows the arrangement of a plurality of identical propellant-charge modules 1 loaded atop one another in random axial orientation. The clear detonation passage 3 allows the igniting flame or blast to propagate from the primer cap 28 in the breech 33 along the entire length much faster than it propagates radially outward through the primer charge 5, 7 (FIG. 1) into the powder 12. Preferably and to eliminate the protective foils 20 (FIG. 2) a standard priming cap 28 with a projectile is used.

The individual propellant-charge modules are externally coated with paint so as to be advantageously protected from moisture and insensitive to flame.

We claim:

1. A propellant-charge pack comprising:

an annular envelope having an outer wall extending along and centered on an axis, a pair of axially spaced end walls extending transversely inward from the axis and having inner peripheries centered on the axis, and an inner wall defining a clear axially throughgoing passage between the inner peripheries of the end walls, the envelope being generally axially symmetrical about the axis and substantially symmetrical to a plane perpendicular to the axis midway between the end walls;

a relatively easily ignited primer charge forming a part of the inner wall symmetrical of the plane;

a propellant charge filling the envelope between the walls outward of the inner wall;

the primer charge being formed by a plurality of axially stacked rings lying radially within and supported by the inner wall.

2. The charge pack defined in claim 1 wherein the primer charge includes nitrocellulose.

3. The charge pack defined in claim 1 wherein the primer charge is shaped as a tube centered on the axis and constituting the inner wall.

4. The charge pack defined in claim 3 wherein the tube has axially opposite ends joined to the inner peripheries of the respective end walls.

5. The charge pack defined in claim 1 wherein the end walls are formed with respective axially centered collars extending axially inwardly toward each other from the respective inner peripheries and having confronting inner ends, the primer charge being between the inner ends.

6. The charge pack defined in claim 5 wherein the primer charge is formed by a plurality of axially stacked rings lying radially within and supported by the inner wall which extends axially between the inner collar ends.

7. The charge pack defined in claim 5 wherein the primer charge is formed by a plurality of axially stacked rings formed with axially interfitting centering formations.

8. The charge pack defined in claim 7 wherein the centering formations of each ring include an axially projecting rim and an axially oppositely open complementary recess.

9. The charge pack defined in claim 7, further comprising spacers between each of the collar inner ends and the stack of primer-charge rings.

10. The charge pack defined in claim 9, further comprising a waterproof but frangible foil blocking the passage at each end wall.

* * * * *

UNITED STATES PATENT AND TRADEMARK OFFICE

CERTIFICATE OF CORRECTION

PATENT NO. : 4,702,167

DATED : October 27, 1987

INVENTOR(S) : Karlheinz REINELT et al

It is certified that error appears in the above-identified patent and that said Letters Patent are hereby corrected as shown below:

On the title page first inventor name should read

-- Karlheinz REINELT --

Signed and Sealed this

Second Day of February, 1988

*Attest:*

DONALD J. QUIGG

*Attesting Officer*

*Commissioner of Patents and Trademarks*